United States Patent [19]

Grube

[11] 4,395,954

[45] Aug. 2, 1983

[54] COUPLING DEVICE FOR MATERIALS-HANDLING CONVEYOR

[75] Inventor: Erwin Grube, Bielefeld, Fed. Rep. of Germany

[73] Assignee: Dürkoppwerke GmbH, Bielefeld, Fed. Rep. of Germany

[21] Appl. No.: 188,540

[22] Filed: Sep. 18, 1980

Related U.S. Application Data

[63] Continuation-in-part of Ser. No. 158,126, Jun. 10, 1980, Pat. No. 4,352,328.

[30] Foreign Application Priority Data

Jun. 13, 1979 [DE] Fed. Rep. of Germany ..... 2923890
Sep. 22, 1979 [DE] Fed. Rep. of Germany ..... 2938474

[51] Int. Cl.[3] ..... B61B 3/00
[52] U.S. Cl. ..... 104/89; 104/172 S; 105/148
[58] Field of Search ..... 104/89, 172 S; 105/148, 105/150

[56] References Cited

U.S. PATENT DOCUMENTS

| | | | |
|---|---|---|---|
| 663,600 | 12/1900 | Chandler | 104/89 |
| 2,821,146 | 1/1958 | Mahrle et al. | 104/89 |
| 3,081,712 | 3/1963 | Schreyer et al. | 104/172 S |
| 3,523,504 | 8/1970 | Jones | 104/172 S |
| 4,287,829 | 9/1981 | Wakabayashi | 104/172 S |

FOREIGN PATENT DOCUMENTS

| | | | |
|---|---|---|---|
| 2650031 | 10/1976 | Fed. Rep. of Germany | 104/172 S |

*Primary Examiner*—Richard A. Bertsch
*Attorney, Agent, or Firm*—Karl F. Ross; Herbert Dubno

[57] ABSTRACT

A coupling device for so-called power and free handling conveyors wherein, for example, a carrier is displaceable along the track and can be coupled to or decoupled from a drive chain by the coupling device. According to the invention, the coupling device comprises a pair of jaws swingably mounted upon a common pivot extending parallel to the track of travel and provided with ramps or camming surfaces designed to spread these jaws to release a carrier or to enable the jaws to engage the carrier. The pivot is provided with an abutment limiting the swinging displacement of the jaws.

7 Claims, 3 Drawing Figures

FIG.1
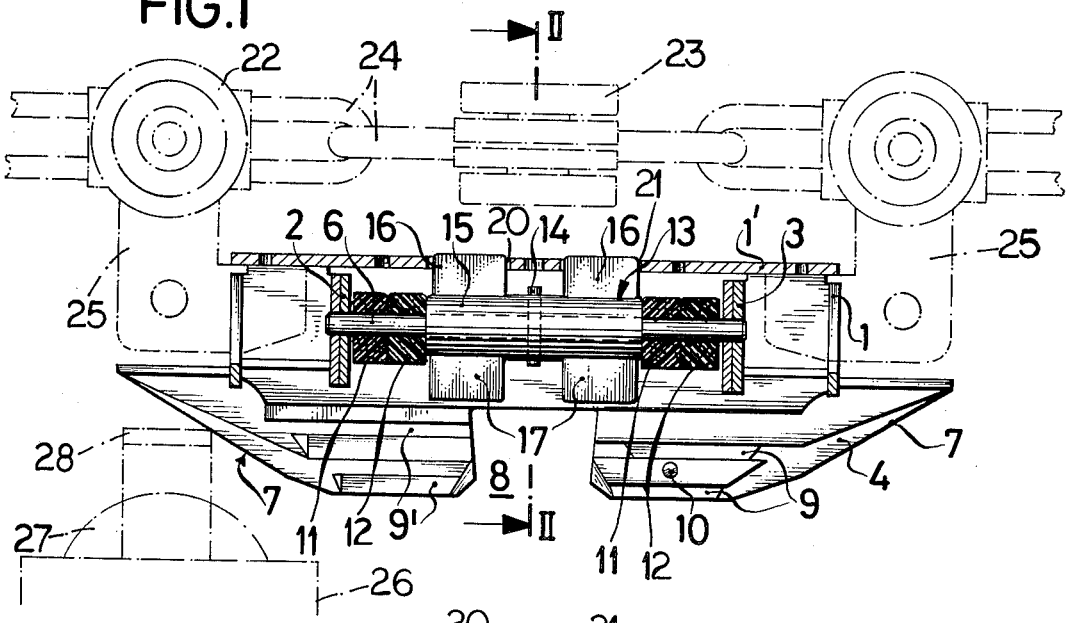
FIG.3
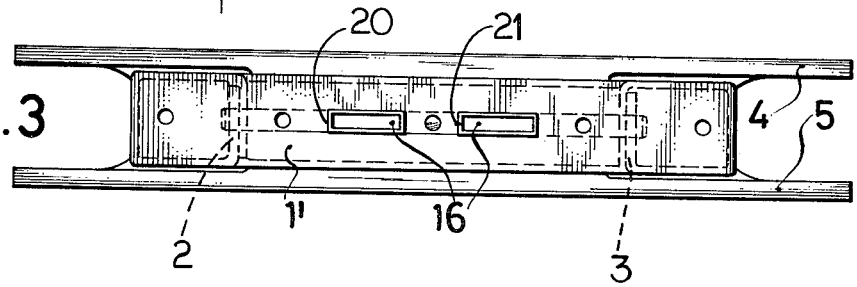
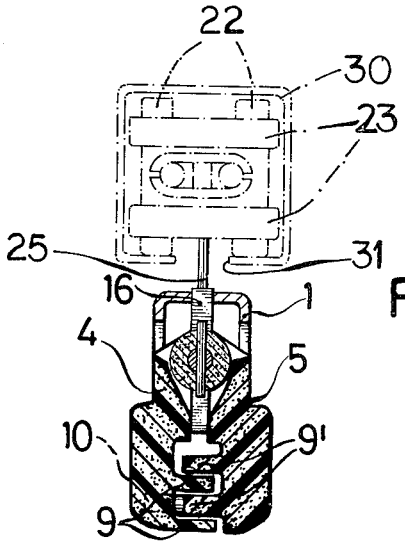
FIG.2

COUPLING DEVICE FOR MATERIALS-HANDLING CONVEYOR

CROSS REFERENCE TO RELATED APPLICATION

The present application is a continuation-in-part of the commonly assigned copending application Ser. No. 158,126 filed June 10, 1980 and entitled "Coupling Assembly for Overhead-Rail Materials-Transport System", now U.S. Pat. No. 4,352,328 issued Oct. 5, 1982.

FIELD OF THE INVENTION

My present invention relates to conveyors and, more particularly, to so-called power and free conveyors of the type in which a material or goods carrier is displaceable along a track, generally an overhead track, from which the carrier is suspended. More specifically, this invention relates to a conveyor of the type described which has an improved coupling device for releasably connecting the carrier to the drive system, generally a chain, whereby the carrier is entrained in powered movement or decoupled for free movement along its track.

BACKGROUND OF THE INVENTION

As described in the aforementioned copending application, conveyor systems having overhead rails upon which carriers can roll and are suspended, may be used in a wide variety of applications.

For example, they can be employed as movable hangers for garments in various stages of manufacture in a garment-manufacturing plant. They may carry baskets, buckets or other receptacles for moving finished and semifinished products about factories and other manufacturing plants, or for delivering raw materials or products to various stations for further manufacturing steps, packaging, sorting and storage. They can be employed wherever redistribution of articles is required, e.g. in postal sorting installations and warehouses, either for collection and delivery of the articles or simply as a system for depositing articles at selected locations.

Finally they may be used for a variety of purposes in large installations such as health institutions for the movement of goods, equipment and supplies, or even for the movement of papers, documents and other information carriers.

The conveyor system with which the present invention is concerned comprises a number of such carriers which can have wheels or trolleys riding upon the rail which can form an endless track from which branches may be diverted so that a carrier may be moved from the main path, diverted to a particular station and/or replaced on the main track.

In nonpowered operation, the carrier is not entrained by a drive and can roll freely along the track, either under gravitational or manual control, or even can be left stationary.

For powered operation, the carrier can be coupled to a drive, e.g. a drive chain which is disposed above and runs parallel with the support track.

In the latter case, the drive chain can be formed at spaced-apart locations with coupling devices adapted to releasably engage a carrier for entrainment of the latter along the track. As is described in the aforementioned copending application, the coupling device can comprise a pair of jaws which are swingable in directions transverse to the direction of displacement of the carrier about a pivot axis running parallel to this direction. At each of the jaws (in the direction of displacement) camming ramps are provided for enabling the spreading of the jaws (and hence release of the carrier) or the opposite movement of the jaws to engage and entrain a respective carrier.

Along the length of the two jaws, there is provided a pocket into which a lug or other entrainer of the carrier engages for such entrainment.

While the system of this application has been found to constitute a major advance and simplification in the conveyor field described, it has been found that some degree of uncontrolled movement of the jaws may be present to result in undesired release of the carrier, especially when strong lateral forces cause one of the jaws to swing away from the other.

Furthermore, operation of the coupling device has been found to be relatively noisy, i.e. the coupling and decoupling operations are carried out only with significant generation of sounds constituting an annoyance to the operators and environment.

OBJECTS OF THE INVENTION

It is, therefore, the principal object of my present invention to provide an improved coupling device whereby the disadvantages of prior art systems are avoided.

Another object of my invention is to provide a materials-handling conveyor which operates with a minimum of noise, even upon coupling and decoupling and which is free from any tendency for involuntary release of the carrier.

Yet another object of the invention is to extend the principles set forth in the above-identified copending application.

SUMMARY OF THE INVENTION

These objects and others which will become apparent hereinafter are attained, in accordance with the invention, by providing a stop member on the pivot which is positioned to prevent both of the jaws from swinging in the same direction, i.e. by forming the stop member as a unidirectionally effective stop for each of the two jaws.

More specifically, the invention relates to a coupling device for a conveyor of the type described in the aforementioned copending application and having a pair of jaws swingably mounted on a common pivot pin extending in the direction of displacement of the chain and carrier which also comprises a sleeve on this pin having a pair of lugs one of which is anchored in the housing supporting the pin while the other extends between inner surfaces of the jaws to limit unidirectionally the swing of each of them. Advantageously, the sleeve is anchored to the pin by a transverse element, e.g. another pin, which prevents rotation of the pin in the housing.

According to another feature of the invention, the elongated jaws are identical and are arranged in mirror-image relationship, being formed of injection-molded bodies of a noise-limiting material such as a low-friction synthetic resin, e.g. filler-containing polytetrafluoroethylene, nylon or the like.

It has been found to be advantageous to provide the confronting surfaces of the jaws, on opposite sides of the opening in which the carrier formation can be received, with longitudinally extending mutually parallel ribs. The ribs of one of the jaws to one side of the opening can thus straddle a rib or engage in grooves between ribs of the other jaw.

The cooperating surfaces of the jaws, when the latter are closed, can also be provided with elastically deformable members functioning as sound-damping members. These members can be elastically deformable and preferably are elastomeric.

BRIEF DESCRIPTION OF THE DRAWING

The above and other objects, features and advantages of the present invention will become more readily apparent from the following description, reference being made to the accompanying drawing in which:

FIG. 1 is a vertical section taken in a plane parallel to the direction of displacement, of a coupling device in accordance with the present invention;

FIG. 2 is a section taken along the line II—II of FIG. 1; and

FIG. 3 is a plan view of the device.

SPECIFIC DESCRIPTION

It will be understood that the operation of the conveyor of the present invention, the method of opening and closing the jaws and other structural details, e.g. of the carrier, rail and chain system can be identical to the corresponding operations and structure of my aforementioned copending application which is hereby included by reference.

More specifically, the conveyor system comprises a track whose rails have not been shown and upon which ride the rollers or trolleys 27 of carriers 26 for the articles to be transported, each carrier having a formation 28 which is engageable in a downwardly open window 8 formed by a pair of jaws 4 and 5.

Above this track, in a chain channel 30, a chain 24 is displaceable and can be continuously driven by sprocket wheels (not shown), the chain having rollers 22 and supporting the load in the vertical direction and additional rollers 23 providing lateral guidance for the chain. Each of the rollers 22 is journaled on a support having a respective L-shaped bracket 25 which reaches into and engages the housing 1 of the coupling device.

The housing 1 is formed from sheet metal and has a pair of transverse double walls 2, 3 formed by bent sections of the sheet metal (see FIG. 3), a pivot pin 6 being received in these double walls.

The coupling jaws 4 and 5 are identical injection-molded bodies composed of filled nylon and thus having excellent noise-damping and low-friction characteristics.

Both ends of the jaws are formed with ramps, camming edges or like formations 7, 7' inclined upwardly and outwardly so that they can be engaged by a member adapted to spread the jaws apart as described in the aforementioned copending application. Centrally, the lower portions of the jaws are formed with cutouts defining the window 8 in which member 28 can be engaged.

The inner confronting walls of the jaws 4 and 5 in the sections between the window 8 and the ramps 7, 7' are formed with parallel longitudinal ribs which are offset from one another so that they interfit (see FIG. 2) and the grooves between these ribs or the ribs adapted to bottom on the grooves are provided with small rubber bumpers 10 forming additional sound-damping members.

The jaws 4 and 5 are also formed unitarily with eyes 11, 12 by which the jaws are pivotally mounted on the rod 6 which also carries an abutment body 13. According to the invention, this abutment body can comprise a sleeve 15 which is locked to the rod 6 by a transverse pin 14 and to each side of this pin, is formed with upwardly and downwardly extending lugs 16 and 17.

The upwardly extending lugs 16 project into openings 20 and 21 of complementary shape and dimension in the housing wall 1' while the downwardly extending lugs 17 project between the inner walls of the jaws 4 and 5. The lugs 16 prevent rotation of the abutment body 13 while the lugs 17 form unidirectionally effective stops for the jaws 4 and 5 preventing the jaw 5, for example, from swinging in the clockwise sense and the jaw 4 from swinging in the counterclockwise sense from the positions shown in FIG. 2.

Thus the abutment member 13 prevents both jaws from swinging past the vertical medium plane of the structure shown in FIG. 2 to one or the other side and releasing member 28, even with sharp lateral or swinging movements of the carrier.

I claim:

1. In a materials conveyor wherein a carrier is displaceable along a track and has a coupling member engageable in a window formed by a pair of jaws pivotally mounted on a housing of a coupling device connected to a drive chain and selectively operable to receive and release said member, the improvement wherein said jaws are mutually juxtaposed, elongated in the direction of displacement along said track, and mounted for swinging movement in opposite senses upon a common pivot rod in said housing extending in said direction, said jaws having ramps for enabling said jaws to be cammed away from one another by said coupling member simultaneously but in opposite senses, said ramps extending in said direction, and wherein said device further comprises an abutment body mounted on said rod and forming unidirectionally effective stops for each of said jaws, said window being formed centrally in said jaws.

2. In a materials conveyor wherein a carrier is displaceable along a track and has a coupling member engageable in a window formed by a pair of jaws pivotally mounted on a housing of a coupling device connected to a drive chain and selectively operable to receive and release said member, the improvement wherein said jaws are mutually juxtaposed, elongated in the direction of displacement along said track, and mounted for swinging movement in opposite senses upon a common pivot rod in said housing extending in said direction, said jaws having ramps for enabling said jaws to be cammed away from one another by said coupling member, said ramps extending in said direction, and wherein said device further comprises an abutment body mounted on said rod and forming unidirectionally effective stops for each of said jaws, said window being formed centrally in said jaws, said abutment body comprising a sleeve having upwardly and downwardly extending lugs, said upwardly extending lugs reaching into openings formed in said housing, said downwardly extending lugs being disposed between inner faces of said jaws.

3. The improvement defined in claim 2 wherein said jaws are identical injection-molded members composed of a low-friction noise-damping material.

4. The improvement defined in claim 3 wherein each of said jaws has a respective section lying on opposite sides of said window and terminating in a ring, said sections being formed with ribs interfitting with the ribs of complementary sections of the other jaw.

5. The improvement defined in claim 4, futher comprising elastic damping members engageable with said ribs.

6. The improvement defined in claim 2, claim 3 or claim 4 wherein said housing is formed from bent sheet metal and has a pair of transverse double walls supporting said rod, said device further comprising a pin traversing said sleeve and said rod.

7. In a materials conveyor wherein a carrier is displaceable along a track and has a coupling member engageable in a window formed by a pair of jaws pivotally mounted on a housing of a coupling device connected to a drive chain and selectively operable to receive and release said member, the improvement wherein said jaws are mutually juxtaposed, elongated in the direction of displacement along said track, and mounted for swinging movement in opposite senses upon a common pivot rod in said housing extending in said direction, said jaws having ramps for enabling said jaws to be cammed away from one another by said coupling member, said ramps extending in said direction, and wherein said device further comprises an abutment body mounted on said rod and forming unidirectionally effective stops for each of said jaws, said window being formed centrally in said jaws wherein said housing is formed from bent sheet metal and has a pair of transverse double walls supporting said rod, said device further comprising a pin traversing said sleeve and said rod.

* * * * *